US009682268B2

(12) United States Patent
Breitkreutz et al.

(10) Patent No.: US 9,682,268 B2
(45) Date of Patent: Jun. 20, 2017

(54) DEAD BLOW WEIGHT CONTROL SYSTEM

(71) Applicant: Fluorotek USA Inc., Palm Beach Gardens, FL (US)

(72) Inventors: Jeffrey Breitkreutz, Stony Plain (CA); David Helbig, Palm Beach Gardens, FL (US)

(73) Assignee: Fluorotek USA Inc., Palm Beach Gardens, FL (US)

( * ) Notice: Subject to any disclaimer, the term of this patent is extended or adjusted under 35 U.S.C. 154(b) by 124 days.

(21) Appl. No.: 14/462,957

(22) Filed: Aug. 19, 2014

(65) Prior Publication Data

US 2016/0051856 A1 Feb. 25, 2016

(51) Int. Cl.

| | |
|---|---|
| ***A63B 21/06*** | (2006.01) |
| ***A63B 21/072*** | (2006.01) |
| ***A63B 71/00*** | (2006.01) |

(52) U.S. Cl.

CPC ..... *A63B 21/0603* (2013.01); *A63B 21/072* (2013.01); *A63B 21/0724* (2013.01);

(Continued)

(58) Field of Classification Search

CPC ..... A63B 21/0602; A63B 21/0603; A63B 21/0601; A63B 21/0726; A63B 21/072

See application file for complete search history.

(56) References Cited

U.S. PATENT DOCUMENTS

| | | | |
|---|---|---|---|
| 702,356 | A | 6/1902 | Calvert |
| 3,226,117 | A | 12/1965 | Walklet |

(Continued)

FOREIGN PATENT DOCUMENTS

| | | |
|---|---|---|
| GB | 191215537 | 11/1912 |
| GB | 2046601 | 11/1980 |

OTHER PUBLICATIONS

Troy, Competition Training Bumper Plates in KG, http://www.troybarbell.com/items.aspx?brand=troy&cat=plate&catnumber=8&item=193, Accessed 2013.

(Continued)

*Primary Examiner* — Sundhara Ganesan
*Assistant Examiner* — Rae Fischer
(74) *Attorney, Agent, or Firm* — Wiggin and Dana LLP; Jonathan D. Hall; Gregory S. Rosenblatt

(57) ABSTRACT

The present invention provides for a weightlifting device as it pertains to the fitness equipment industry. In an embodiment of the present invention, there is provided a new type of weight to be used in weightlifting. One embodiment provides for a weight plate to be used on barbells. Other configurations are possible, including a fixed-weight dumbbell, a weight plate to be added to the bar of an adjustable dumbbell, a kettlebell, or other weightlifting apparatus. In an embodiment, each weight is manufactured to have an hollow insert in the center of the weight. The hollow insert is filled with a specified volume of relatively high mass flowable material, such as lead shot. When the barbell is dropped, the flowable material shifts within the hollow insert and limits the rebound. In this way, the force of the impact is transmitted solidly to the floor, thus dampening the impact. This feature of dampening the rebound of a device upon impact by utilizing a flowable material within a hollow chamber in the device is sometimes referred to as "dead blow." The hollow insert may comprise a either a single large chamber for the flowable filler material or have multiple ports through which the flowable filler material is inserted. An additional function of the flowable filling is to help to control the accuracy of the actual required weight of the finished product.

6 Claims, 3 Drawing Sheets

(52) U.S. Cl.
CPC ..... *A63B 21/0726* (2013.01); *A63B 71/0054* (2013.01); *A63B 2071/0063* (2013.01)

(56) References Cited

U.S. PATENT DOCUMENTS

| | | | | | |
|---|---|---|---|---|---|
| 4,029,312 | A | | 6/1977 | Wright | |
| 4,076,236 | A | | 2/1978 | Lonel | |
| 4,103,887 | A | | 8/1978 | Shoofler | |
| 4,121,826 | A | * | 10/1978 | Liberatore | A45C 1/12 232/4 R |
| 4,538,806 | A | * | 9/1985 | Wilkerson | A63B 21/0726 482/108 |
| 4,743,016 | A | * | 5/1988 | Van Derworp | A63B 21/075 482/93 |
| 5,464,379 | A | | 11/1995 | Zarecky | |
| 5,509,877 | A | | 4/1996 | Adams | |
| 5,967,952 | A | | 10/1999 | Bronstein et al. | |
| 6,315,699 | B1 | | 11/2001 | Romero | |
| 7,517,305 | B2 | | 4/2009 | Lien | |
| 7,775,947 | B2 | | 8/2010 | Towley, III | |
| 8,888,665 | B2 | * | 11/2014 | Pfitzer | A63B 21/0602 482/104 |
| 2006/0160675 | A1 | | 7/2006 | Brown | |
| 2009/0093348 | A1 | * | 4/2009 | Wang | A63B 21/0603 482/93 |

OTHER PUBLICATIONS

Atomic Athlete, Classic MILO Bar Bell Tribute Set, http://atomicathletic.com/store/index.php/barbells-plates/weight-sets/classic-milo-bar-bell-tribute-set.html, Accessed 2013.

LYNX Barbell, https://www.facebook.com/permalink.php?id=245160748862961&story_fbid=457882667590767, Accessed 2013.

* cited by examiner

DEAD BLOW WEIGHT CONTROL SYSTEM

FIELD OF THE INVENTION

The present invention relates to physical fitness equipment, particularly to a dead blow weight control system for use in weightlifting.

BACKGROUND OF THE INVENTION

In competitive or recreational weightlifting, weights are often dropped from a height and allowed to fall unguided until they strike the floor. For example, in Olympic weightlifting events such as the Snatch and the Clean and Jerk, a weightlifting bar with attached weight plates is dropped from above the athlete's head directly onto the floor surface or lifting platform at the level of the athlete's feet. In non-competitive weightlifting, it is also common for the weightlifter to drop his weights, particularly when performing certain exercises, such as deadlifts, bench presses, and overhead presses. When lifting heavy or maximum weight, a weightlifter may be unable to control the drop and may risk injury to himself if he does so. Alternatively, if the weightlifter were to stay in control to the extent that he could guide the weight to the floor after his lift rather than dropping it, he would not be able to lift his maximum weight.

This unguided drop of a heavy weight can result in damage to the equipment itself, the floor, and any nearby objects. In addition, the freely dropped weight risks injury to persons standing near it, such as the weightlifter who dropped it.

International Weightlifting Federation (IWF) Technical Rules, which are used in the Olympic Games and World Weightlifting Championships, require that any plates used in competition be covered in rubber or plastic. Non-competition weight plates are also often rubber-coated or fully rubber to reduce damage to the weights and the weightlifting floor. Such plates are often called bumper plates, Olympic plates, or elite plates. These rubber or rubberized plates rebound even higher than non-rubber plates upon hitting the floor, and the weights may collide with the weightlifter's shins, knees, or other body parts and cause an injury.

To minimize this risk of injury due to the rebound, some bumper weights seek to minimize bounce based on the type of rubber they utilize. But such lower bounce rubber weights can bring about other problems, such as being too wide to meet competition standards, being limited in the maximum mass, or suffering cracking over time.

Another important concern in the sport of competitive weightlifting is the accuracy of the weights used. For example, IWF rules require tight tolerances for the weights used: +0.1% and −0.05% per weight weighing more than 5 kg and +10 grams and −0 grams per part weighing less than 5 kg.

Manufacturing solid weights in a single piece can present difficulties in meeting these tight tolerances required for competitive weightlifting under IWF rules. For example, typical tolerances expected in steel castings under 45 kg are approximately ±5%. See Steel Castings Handbook 16-13 (Malcolm Blair and Thomas L. Stevens, 6th ed. 1995). Many labor intensive operations may be employed to control cast weights to tight tolerances, including grinding, milling, or filing. In the field of weightlifting, solutions to meeting tight tolerances have included designating a specific area of the weight to be filed or milled to decrease the weight. See, e.g., U.S. Pat. No. 7,517,305, Col. 6:11-14. Another solution to manufacturing weights to meet tight tolerances include adding indentations to a weight where additional material may be added after casting and kept in place by way of packing, resin, or a covering. Id., Col. 6:15-35. In all events, the difficulty in meeting these tight tolerances adds significantly to the cost of the weight to the end-consumer.

SUMMARY OF THE INVENTION

The present invention provides for a weightlifting device as it pertains to the fitness equipment industry. In an embodiment of the present invention, there is provided a new type of weight to be used in weightlifting. One embodiment provides for a weight plate to be used on barbells. Other configurations are possible, including a fixed-weight dumbbell, a weight plate to be added to the bar of an adjustable dumbbell, a kettlebell, or other weightlifting apparatus. In an embodiment, each weight is manufactured to have an hollow insert in the center of the weight. The hollow insert is filled with a specified volume of relatively high mass flowable material, such as lead shot. When the barbell is dropped, the flowable material shifts within the hollow insert and limits the rebound. In this way, the force of the impact is transmitted solidly to the floor, thus dampening the impact. This feature of dampening the rebound of a device upon impact by utilizing a flowable material within a hollow chamber in the device is sometimes referred to as "dead blow." The hollow insert may comprise a either a single large chamber for the flowable filler material or have multiple ports through which the flowable filler material is inserted. An additional function of the flowable filling is to help to control the accuracy of the actual required weight of the finished product.

DETAILED DESCRIPTION OF EXEMPLARY EMBODIMENTS

Herein below, an exemplary embodiment of this invention will be described in detail with reference to the drawings.

Figure 1:
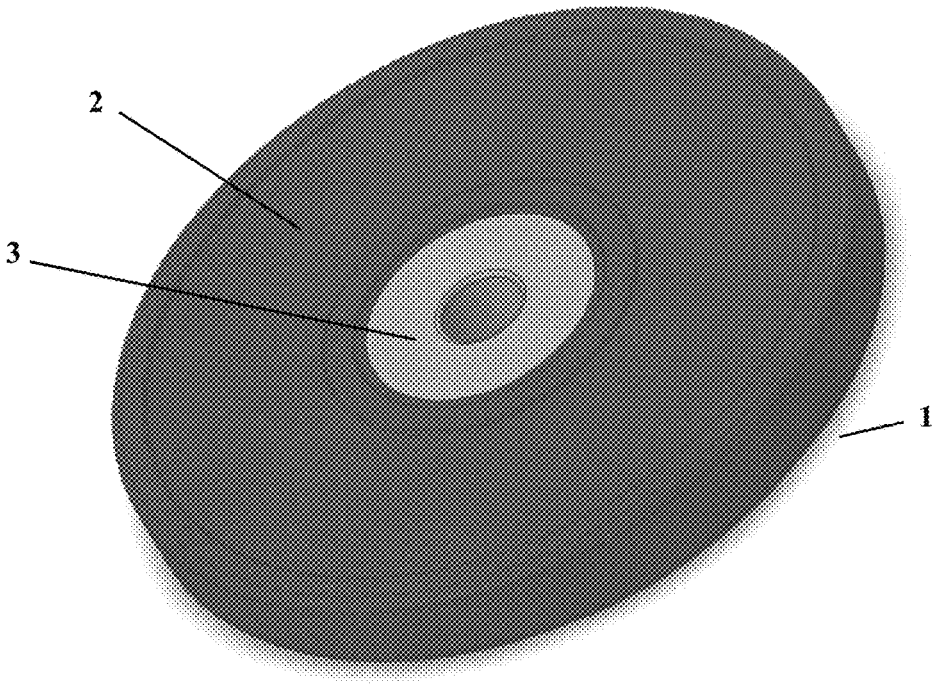
FIG. 1 is a perspective view of a complete weight plate with insert.

FIG. 1 shows a circular weight plate 1 comprising an outer body 2 and an insert 3. The outer body 2 may be made from a range of materials, including, but not limited to, iron, steel, composite rubber, or rubber. The outer body 2 may be cast, machined, or otherwise processed to achieve the desired shape. The outer body 2 may be rubber coated, polyurethane coated, or otherwise altered by adding or removing material during the manufacturing process. The outer body 2 may comprise multiple pieces so long as they are joined together to form a singular outer body 2. These pieces may be joined by any joining process including, but not limited to, threading, bolting, riveting, screwing, welding, brazing, soldering, or gluing. The outer body 2 is relatively rigid, meaning that it is not pliable but instead is sufficiently rigid to maintain the configurational integrity of its shape when under resting forces. The outer body 2 may be formed in the shape of a weight plate for loading onto a barbell.

The insert 3 may likewise be made from a range of materials, including, but not limited to, iron, steel, composite rubber, or rubber. The insert 3 may be cast, machined, or otherwise processed to achieve the desired shape. The insert 3 may be rubber coated, polyurethane coated, or otherwise altered by adding or removing material during the manufacturing process. The insert 3 may comprise multiple pieces so long as the pieces are joined together to form a singular insert which is at least partially hollow. These pieces may be joined by threading, bolting, riveting, screwing, welding, brazing, soldering, gluing, or other joining process.

Figure 2:
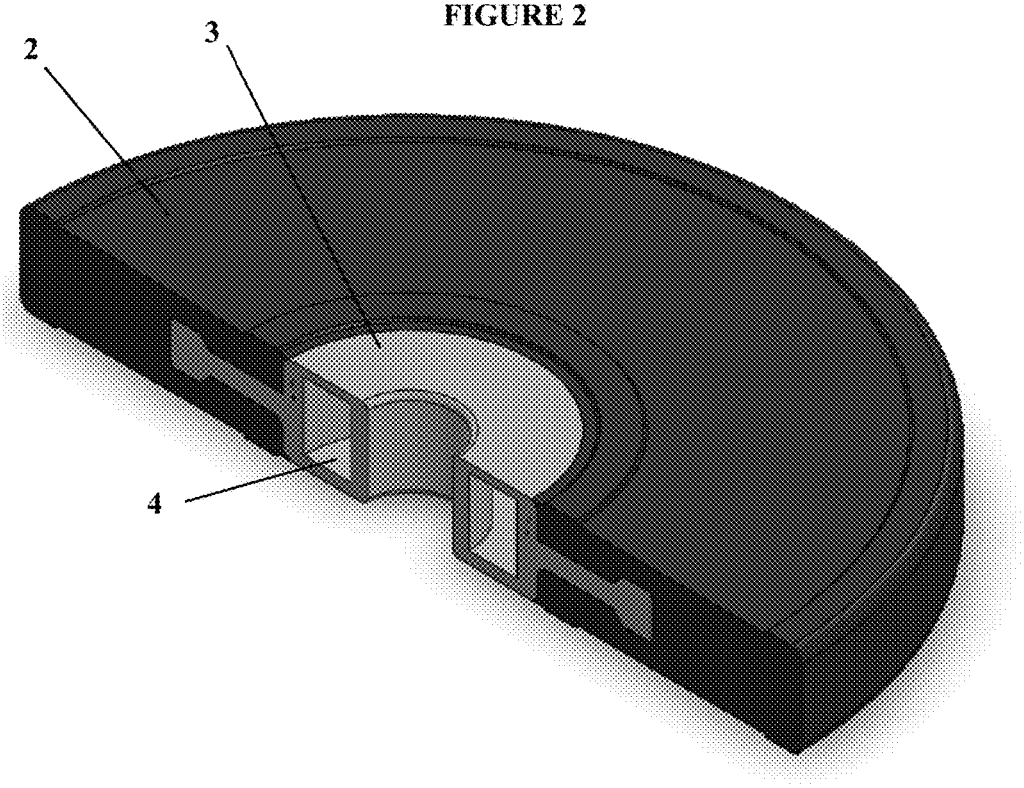
FIG. 2 is a cross-sectional view of the outer body and hollow insert of a weight plate. A flowable filler material such as lead shot would be enclosed within the hollow insert to complete this embodiment of the invention.

FIG. 2 shows a cross-sectional view of the weight plate 1. This view shows the hollow portion 4 of insert 3. The hollow portion 4 need not be a completely closed chamber; in other words, the hollow portion 4 may include a non-sealed opening or openings 5. In an embodiment, the hollow portion 4 is completely enclosed by the body of the insert 3. In other embodiments, the insert 3 includes an opening or openings 5 to the hollow portion 4. In still other embodiments, the hollow portion 4 comprises multiple hollow chambers which may be completely sealed by the body of the insert 3 or may include an opening or openings 5 in the body of the insert 3.

A relatively high mass flowable filler material 6 is added to the hollow portion(s) 4 of the insert 3 prior to sealing. This flowable filler material 6 may comprise lead, lead shot, sand, steel shot, or any substantially heavy and flowable material that would dampen the rebound upon impact. No matter the specific flowable filler material 6 chosen, a specified amount is inserted into the insert 3 and the insert 3 is then encapsulated by the outer body 2. Although the body of the insert 3 may contain an opening or openings 5 to the hollow portion 4, in a fully assembled weight plate 1, these openings 5 are covered by the outer body 2. Thus, the assembled weight plate 1 fully encloses the filler material 6 such that it is not adjustable by the end-user. The amount of filler material 6 may be adjusted in the manufacturing process to ensure that the weight meets the desired manufacturing specifications to tight tolerances, and the insert 3 is then sealed so that the filler 6 will not diminish over use of the product, and to prevent the end-user of the product from easily accessing or altering the weight of the product by adjusting the amount of filler 6 within the insert 3.

In an embodiment, the amount of filler material 6 is adjusted during manufacturing to adjust the weight of the plate 1 to desired specifications. After assembly of the complete weight plate, the amount of filler material 6 within the plate 1 is non-adjustable as there are no practicable ways of deconstructing the assembled plate 1 or otherwise adjusting the amount of filler material 6. For example, there are no user-accessible openings for the end-user to add or remove filler material, nor may the insert 3 be removed from the assembled plate.

The weight plate 1 comprising an outer body 2 and an insert 3 may be manufactured by joining multiple pieces of component parts 2,3 to form a complete weight plate. As shown by the cross-sectional view of the weight plate 1 in FIG. 2, one portion (i.e., one half) of an insert 3 and an outer body 2 may be joined with another assembled portion or portions to form a complete weight plate 1. The portions of insert 3 may be joined by way of threading the portions together. In another embodiment, the portions may be bolted together. In still other embodiments, the portions may be riveted, screwed, welded, brazed, soldered, glued, or otherwise joined together.

Figure 3:
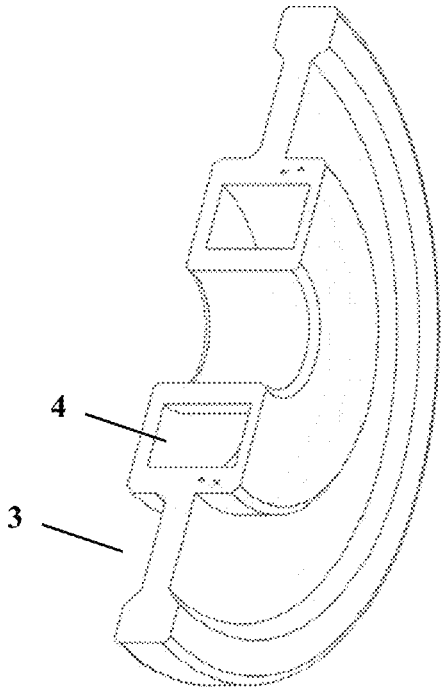
FIG. 3 is a cross-sectional view of the hollow insert.
Figure 4:
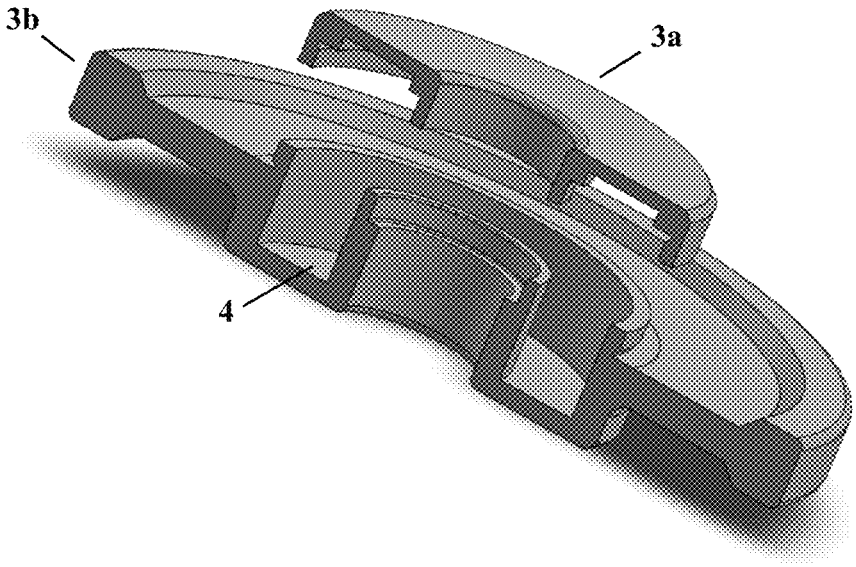
FIG. 4 is a cross-sectional view of the hollow insert separated into two component parts.

FIGS. 3-6 show the insert 3 without the outer body 2. FIG. 3 shows a cross-sectional view of the insert 3 depicted in FIG. 2. FIG. 4 shows the insert 3 depicted in FIG. 3 but in two parts: a top portion of the insert 3*a* and a bottom portion of the insert 3*b*.

Figure 5:
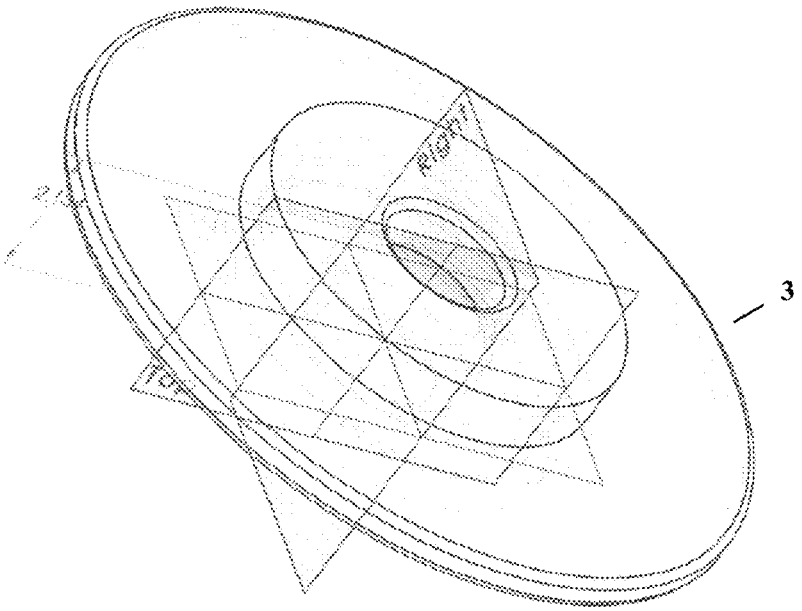
FIG. 5 is a perspective view of an assembled insert.
Figure 6:
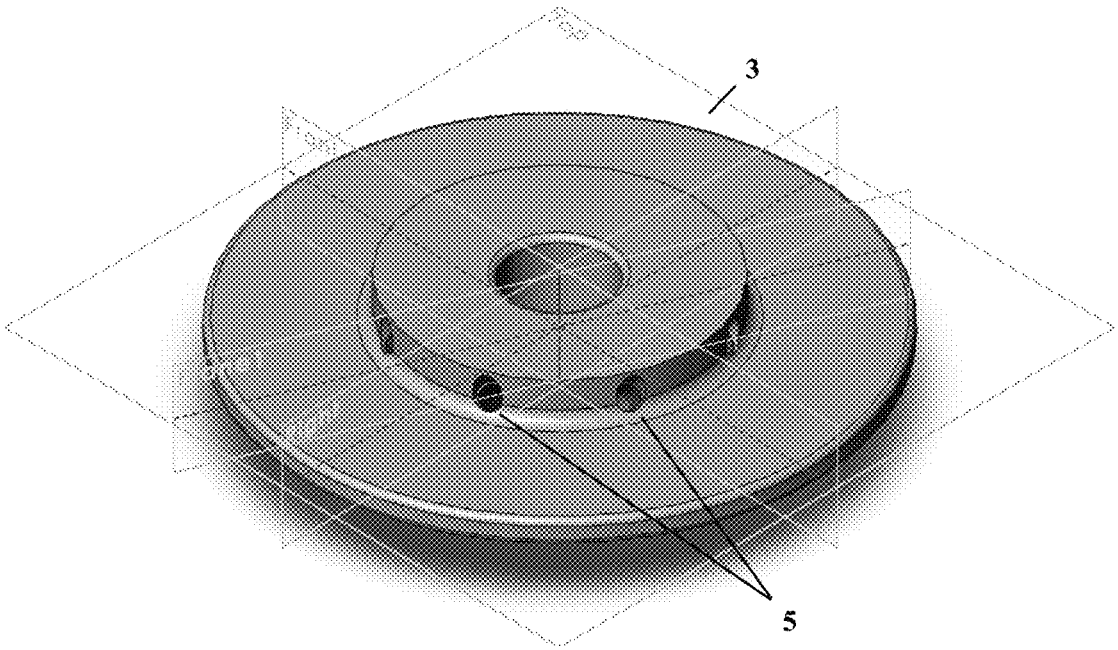
FIG. 6 is another perspective view of an assembled insert with pocks through which the shot may be inserted.

FIGS. 5-6 show a full perspective view of the insert 3. FIG. 5 shows the insert 3 with a solid casing which fully encloses the hollow portion. FIG. 6 shows the insert 3 with multiple openings 5 through which the flowable filler material 6 may be inserted into a single hollow chamber or multiple chambers accessible through the openings 5.

In another embodiment of the invention, the weight plate 1 may be octagonal, square, or some other non-circular shape. The weight plate 1 may be rounded or otherwise textured rather than flat. The weight plate 1 may be sized to fit as a plate on a small bar to form a dumbbell, rather than on a barbell.

In another embodiment of the invention, the weight 1 may be configured in a shape other than a weight plate. The shape of the weight 1 may include, but is not limited to, the shape of a dumbbell, kettlebell, or a weight bar. In other embodiments, the weight may be configured to be used as a component part of a dumbbell, kettlebell, a weight bar, or other apparatus.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. A weightlifting device comprising;

a weight plate outer body; and a hollow toroidal insert having a center hole, wherein the weight plate outer body substantially surrounds the hollow toroidal insert and is sufficiently rigid to maintain the shape of the weightlifting device when under resting forces, wherein the hollow toroidal insert is permanently affixed within the weight plate outer body, wherein the center hole of the hollow toroidal insert is configured for interconnection with a barbell, and wherein the hollow chamber is filled with a flowable filler material that is capable of shifting upon impact of the device so as to dampen the impact.

2. The weightlifting device of claim 1, wherein the flowable filler material comprises lead, lead shot, steel shot, or sand.

3. The weightlifting device of claim 1, wherein the insert comprises:

a bottom portion; and a top portion, wherein the bottom portion and the top portion are configured to interlock.

4. The weightlifting device of claim 1, wherein the hollow toroidal insert has an opening configured to receive the flowable filler material during filling.

5. The weightlifting device of claim 4, wherein the opening is configured to be sealed after filling.

6. The weightlifting device of claim 1, wherein the weight plate outer body is comprised of iron, steel, metal or metal alloy.

* * * * *